US005602370A

United States Patent [19]

Kau

[11] Patent Number: 5,602,370

[45] Date of Patent: Feb. 11, 1997

[54] SAFETY SWITCH FOR ELECTRIC ROLLING DOORS

[76] Inventor: David Kau, No. 24, Lane Ting-Keng, Ching-Yung Tsun, Chung-Liao Hsiang, Nantu Hsien, Taiwan

[21] Appl. No.: 522,936

[22] Filed: Sep. 1, 1995

[51] Int. Cl.[6] ..... H01H 3/16

[52] U.S. Cl. ..... 200/61.43

[58] Field of Search ..... 200/61.43, 85 R, 200/86 R; 49/26–29

[56] References Cited

U.S. PATENT DOCUMENTS

| | | | |
|---|---|---|---|
| 2,823,279 | 2/1958 | Schulenburg | 200/86 R |
| 3,321,592 | 5/1967 | Miller | 200/61.43 |
| 4,051,336 | 9/1977 | Miller | 200/61.43 |
| 4,137,116 | 1/1979 | Miller | 200/86 R X |
| 4,532,388 | 7/1985 | Sackmann et al. | 200/61.43 |
| 5,023,411 | 6/1991 | Miller et al. | 200/61.43 |

*Primary Examiner*—J. R. Scott

*Attorney, Agent, or Firm*—Bacon & Thomas

[57] ABSTRACT

A safety switch including a follower bar molded from elastic material and fastened to the bottom rail of an electric rolling door and having two longitudinal ribs on the inside, two metal sheets mounted inside within the follower bar above the longitudinal ribs and separated by a slotted sheet insulator, two actuators respectively fastened to two opposite ends of the bottom rail of the electric rolling door, each actuator having a top plate fastened to one end of the bottom rail of the electric rolling door, and two crossed pressure bars respectively pivoted to the top plate, wherein when the follower bar or one actuator is stopped by an object during the down stroke of the electric rolling door, the follower bar is deformed to force the longitudinal ribs upwards against the metal sheets, causing the metal sheets to contact each other at holes on the sheet insulator and to further cut off power supply from the electric rolling door.

3 Claims, 7 Drawing Sheets

SAFETY SWITCH FOR ELECTRIC ROLLING DOORS

BACKGROUND OF THE INVENTION

The present invention relates to a safety switch for electric rolling doors which automatically cut off power supply from the electric rolling door, when two metal sheets thereof are forced into contact with each other, as the electric rolling door is stopped by an object during its down stroke.

Regular electric rolling doors are commonly equipped with a safety switch, which automatically cuts off power supply when the electric rolling door is stopped by an object during its down stroke. FIG. 1 shows a safety switch for this purpose, which is comprised of two overlapped metal sheets and an insulative sheet retained between the metal sheets. When the metal sheets and the insulative sheet are arranged together, they are covered with rubber by a molding machine. The insulative sheet has a plurality of through holes so that the metal sheets can contact each other when the safety switch is vertically compressed. This safety switch structure is still not satisfactory in function. The drawbacks of this safety switch structure are numerous and outlined hereinafter. Because the effective induction area of the safety switch is limited to a narrow area right below the metal sheets corresponding to the holes on the insulative sheet, the safety switch does not work if it is stopped by an object at the corner area during the down stroke of the electric rolling door. Furthermore, when the metal sheets and the insulative sheet are arranged together and covered with rubber by a molding machine, the molded device is rolled up, and then cut to the desired length subject to the size of the electric rolling door. Because the safety switch is rolled up before it is cut to the desired length, the metal sheets tend to be wrinkled or deformed. When the metal sheets are wrinkled or deformed, the sensitivity of the safety switch is affected. In order to increase the sensitivity of the safety switch, an elastic casing may be used (see FIG. 3). This elastic casing is molded from elastic material having inside ribs, and a receiving chamber above the inside ribs for mounting the safety switch. This arrangement greatly increases the installation cost of the safety switch. Furthermore, the safety switch cannot be effectively induced to cut off power supply from the electric rolling door when the electric rolling door is stopped by an object in the opposite vertical sliding grooves along which the electric rolling door slides.

SUMMARY OF THE INVENTION

The present invention has been accomplished to provide a safety switch for electric rolling doors which eliminates the aforesaid drawbacks.

It is one object of the present invention to provide a safety switch for electric rolling doors, which is safety in use. It is another object of the present invention to provide a safety switch for electric rolling doors which has high sensitivity and is effective in use.

According to one aspect of the present invention, the safety switch comprises a follower bar molded from elastic material and fastened to the bottom rail of an electric rolling door and having two longitudinal ribs on the inside, two metal sheets mounted inside within the follower bar above the longitudinal ribs and separated by a slotted sheet insulator. When the follower bar is stopped by an object during the down stroke of the electric rolling door, the follower bar is deformed to force the ribs against the metal sheets, causing metal sheets to contact each other at holes on the sheet insulator and to further cut off power supply from the electric rolling door.

According to another aspect of the present invention, two actuators are respectively fastened to two opposite ends of the bottom rail of the electric rolling door, each actuator having a top plate fastened to one end of the bottom rail of the electric rolling door, the top plate having two crossed pressure bars respectively pivoted to the top plate. When the crossed pressure bars of one actuator is stopped by an object during the down stroke of the electric rolling door, the metal sheets are forced into contact with each other at the holes on the sheet insulator, and to further cut off power supply from the electric rolling door.

DETAILED DESCRIPTION OF THE PREFERRED EMBODIMENT

Figure 1:
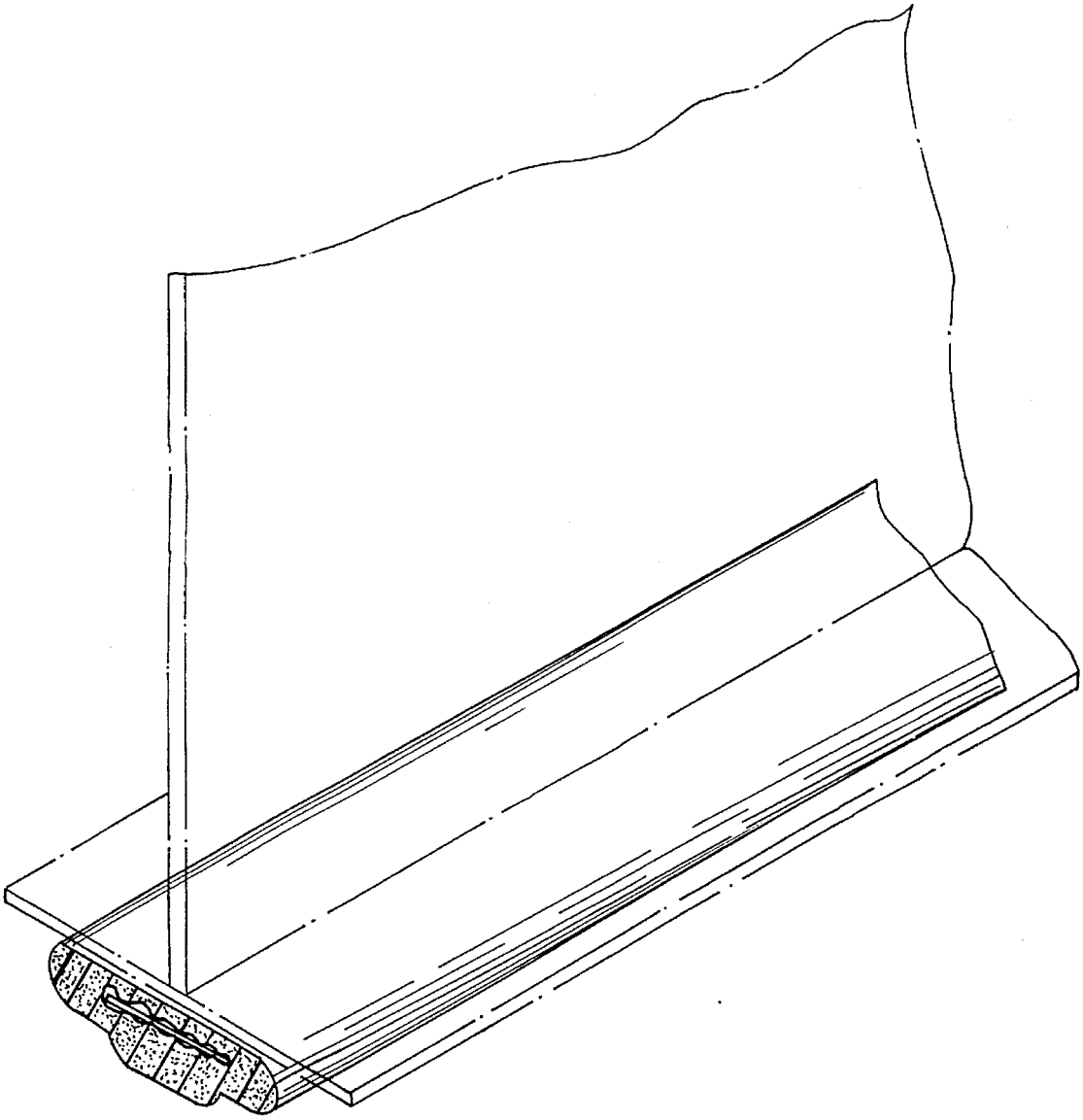
Fig. 1 PRIOR ART
FIG. 1 shows a safety switch for electric rolling door according to the prior art.
Figure 2:
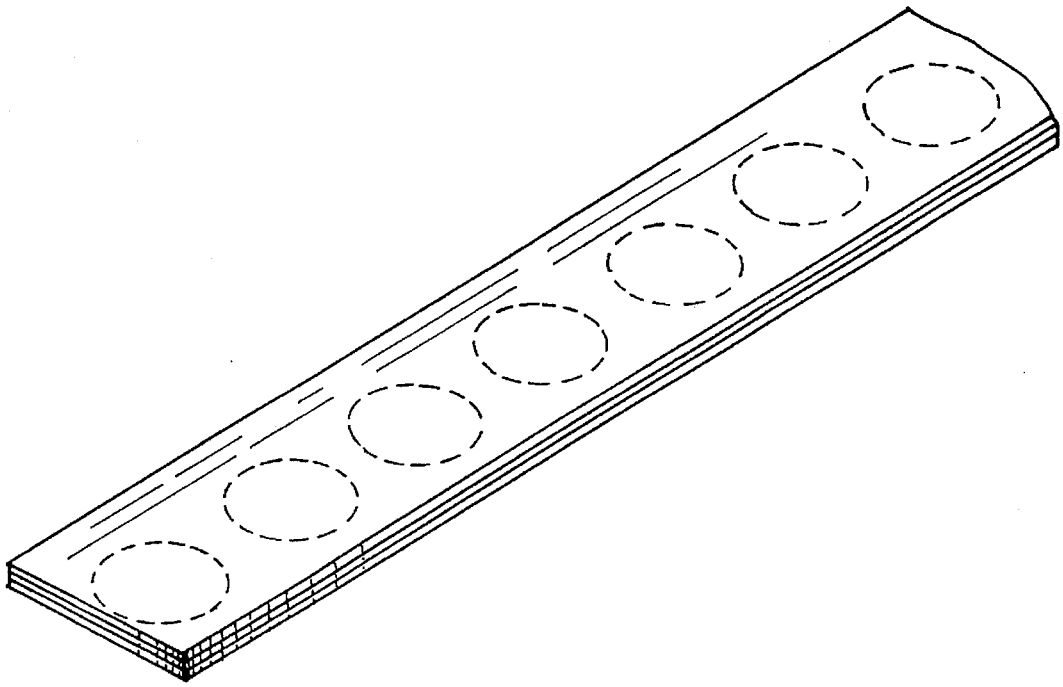
Fig. 2 PRIOR ART
FIG. 2 is a perspective view of the metal sheets with the insulative sheet for the prior art safety switch shown in FIG. 1.
Figure 3:
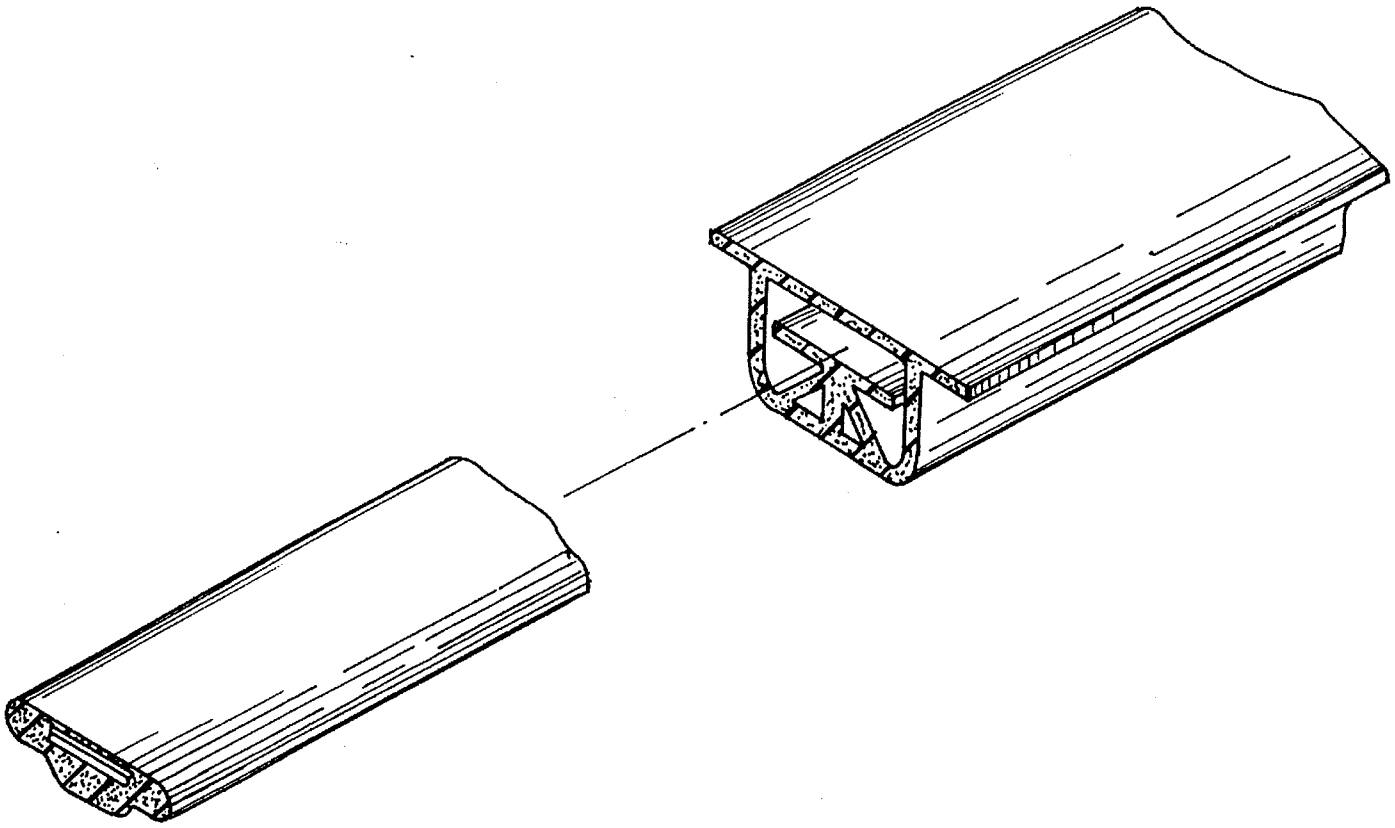
Fig. 3 PRIOR ART
FIG. 3 shows an elastic casing for the prior art safety switch shown in FIG. 1.
Figure 4:
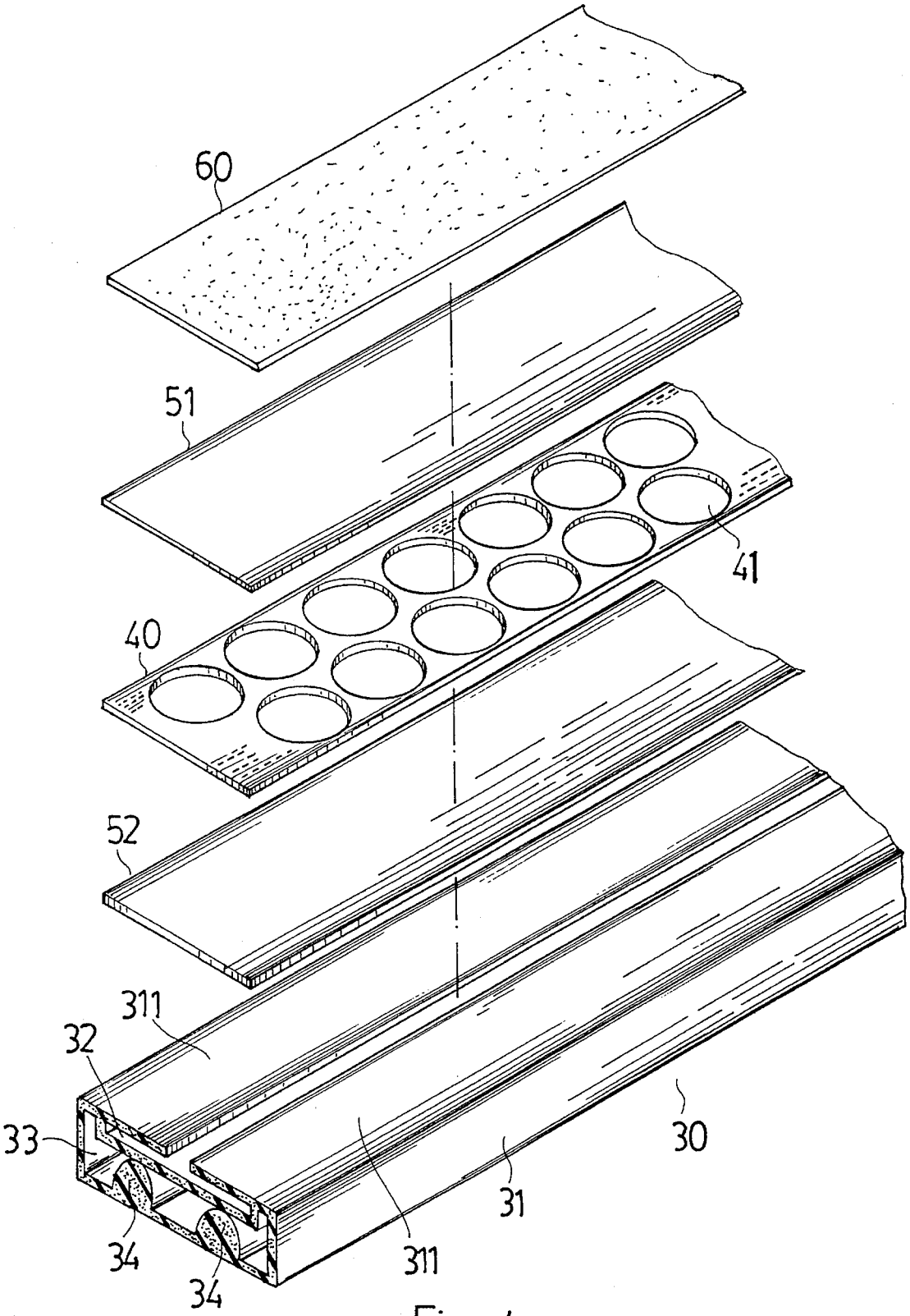
FIG. 4 is an exploded view of a safety switch for electric rolling doors according to the present invention.
Figure 5:
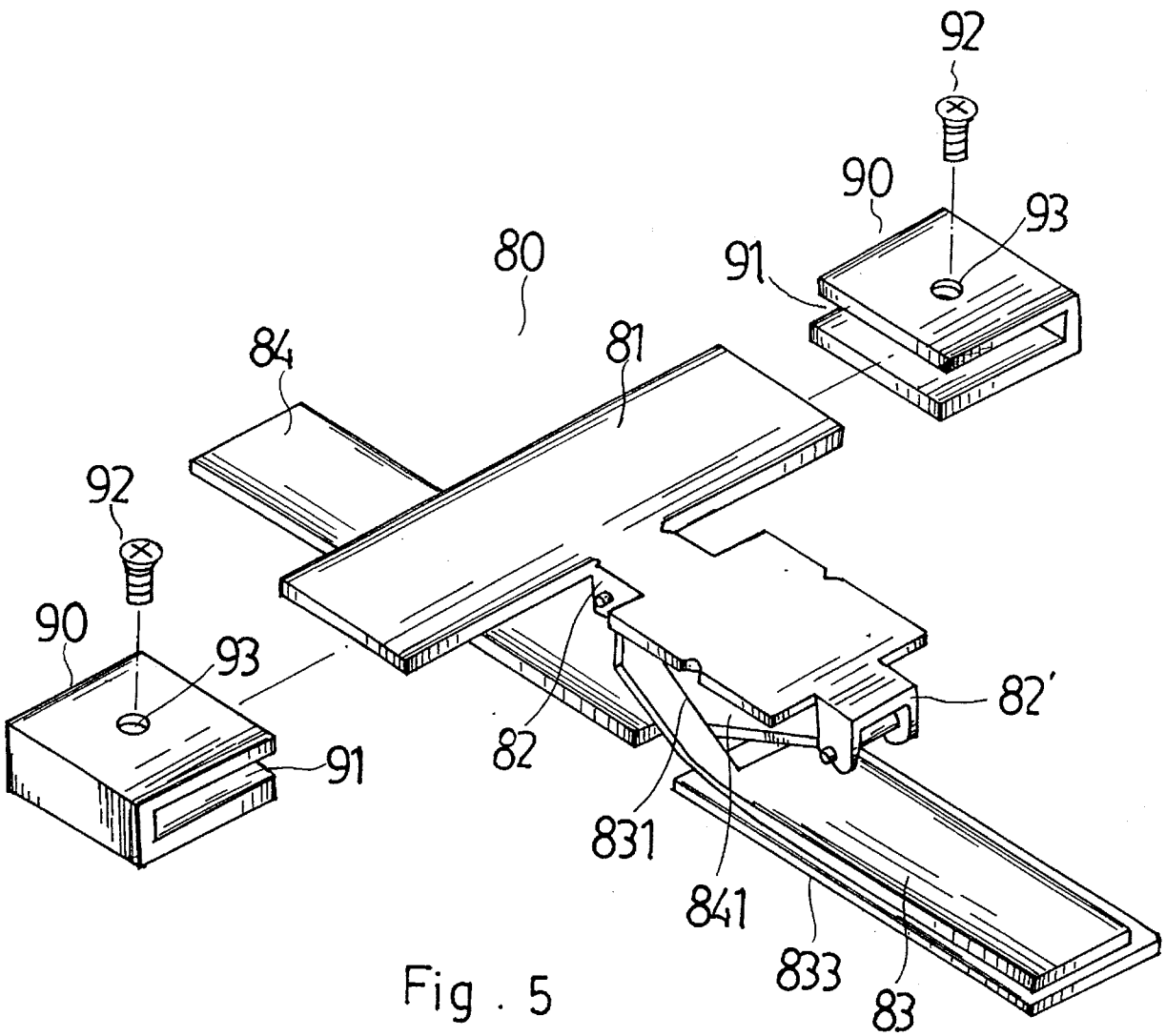
FIG. 5 shows an actuator according to the present invention.

Referring to FIGS. 4 and 5, a safety switch for electric rolling doors in accordance with the present invention is generally comprised of a follower bar 30, a sheet insulator 40, a first metal sheet 51, a second metal sheet 52, a rubber packing sheet 60, and two actuators 80. The follower bar 30 is molded from elastic material, comprising a longitudinal top open chamber 32, two parallel top flaps 311 bilaterally and partially covered over the top open chamber 32, an longitudinal inside chamber 33, and two longitudinal ribs 34 raised from the bottom of the longitudinal inside chamber 33. The sheet insulator 40 is mounted inside the top open chamber 32 above the longitudinal ribs 34 and retained between the first metal sheet 51 and the second metal sheet 52, having two longitudinal rows of through holes 41 corresponding to the longitudinal ribs 34. By bending the top flaps 311 bilaterally outwards, the sheet insulator 40 with the metal sheets 51 and 52 are placed inside the top open chamber 32. When the sheet insulator 40 with the metal sheets 51 and 52 are placed inside the top open chamber 32, the top flaps 311 are released and cover the first metal sheet 51. Then the rubber packing sheet 60 is adhered to the top panel 311 (see also FIG. 6).

Referring to FIG. 5 again, the actuator 80 comprises a top plate 81 having two pairs of downward lugs, namely, the first pair of downward lugs 82 and the second pair of downward lugs 82', a first pressure plate 83 having one end bent obliquely upwards and pivoted to the first pair of downward lugs 82 and stopped against the bottom side of the top plate 81 at a predetermined angle, a second pressure plate 84 having an oblique front extension 841 inserted through a through hole 831 on the first pressure plate 83 and pivoted to the second pair of downward lugs 82', and a stop plate 833 fixed to the bottom side of the first pressure plate 83 and stopped against the bottom side of the front extension 841 of the second pressure plate 84.

Figure 6:
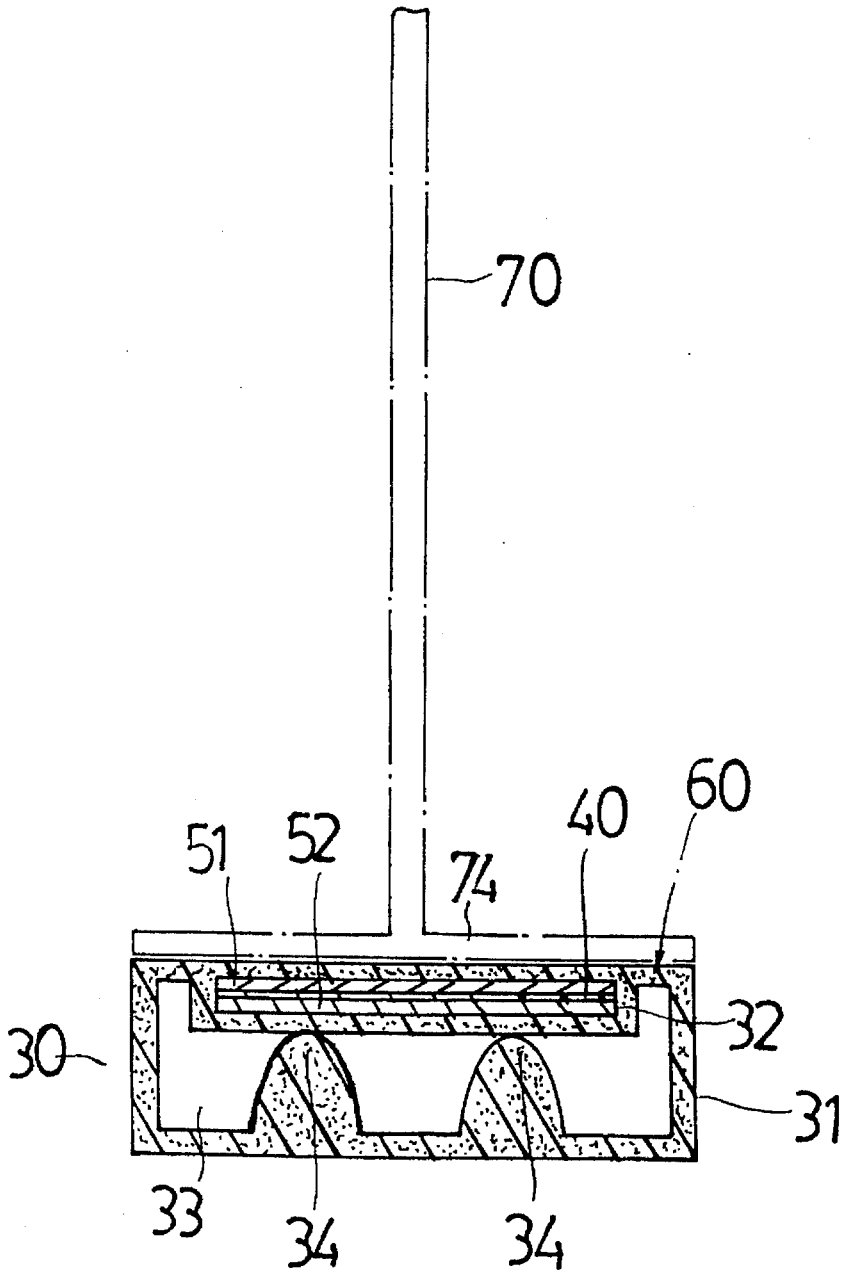
FIG. 6 is an end view in section showing the safety switch installed in an electric rolling door according to the present invention.
Figure 7:
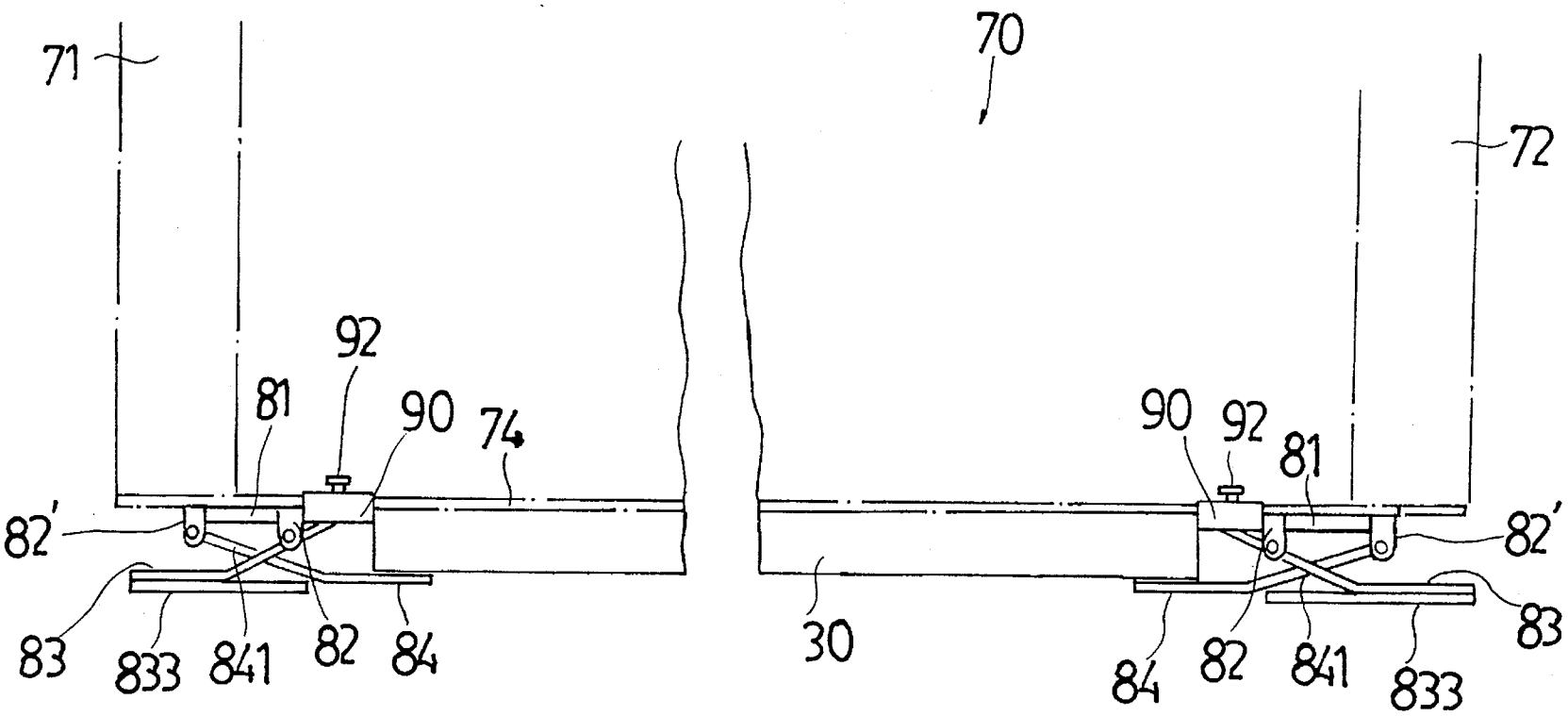
FIG. 7 is a front plain view showing the actuators installed in the bottom rail of the electric rolling door according to the present invention.

Referring to FIGS. 6 and 7 and FIG. 5 again, during the installation of safety switch, the rubber packing sheet 60 is adhered to the bottom side of the bottom rail 74 of the electric rolling door 70. When the rolling door 70 is stopped by an object during its down stroke, an upward reactive force is transferred from the object to the follower bar 30, causing the casing 31 to be compressed. The first metal sheet 51 and the second metal sheet 52 are forced into contact with each other at the through holes 41. When the first metal sheet 51 and the second metal sheet 52 are forced into contact with each other, the pressure plates 83 and 84 of the actuators 80 cause the electric rolling door 70 to stop. As illustrated, the electric rolling door 70 is moved between two vertical sliding grooves 71 and 72. The actuators 80 are fastened to two opposite ends of the bottom rail 84 of the electric rolling door 70 by locating plates 90. As shown in FIGS. 5 and 7, the locating plate 90 has a horizontal coupling hole 91 at one side, which receives the bottom rail 74 of the electric rolling door 70 and the top plate 81 of the respective actuator 80, and a locating hole 93 at the top side. A tightening up screw 92 is threaded into the locating hole 93 to hold down the bottom rail 74 and the top plate 81. When installed, as shown in FIG. 7, the second pressure plate 84 is attached to the bottom side of the follower bar 30, and the first pressure plate 83 is perpendicularly inserted into the vertical sliding groove 71 or 72. Therefore, if there are objects in the vertical sliding grooves 71 and 72 to hinder the downward movement of the electric rolling door 70, the first pressure plate 83 will be forced upwards to turn the second pressure plate 84, causing the second pressure plate 84 to compress the casing 31 of the follower bar 30. When the casing 31 of the follower bar 30 is compressed by the follower bar 30, the first metal sheet 51 and the second metal sheet 52 are forced into contact with each other to further stop the operation of the electric rolling door 70.

The effects and advantages of the present invention is outlined hereinafter.

1) When the follower bar 30 is molded, it is cut at the desired length, then the metal sheets 51 and 52 and the sheet insulator 40 are fastened to the top open chamber 32 of the follower bar 30, and then the rubber packing sheet 60 is adhered to the top panel 311 of the follower bar 30. This assembly process is simple. Furthermore, the assembly process does not deform the metal sheets 51 and 52. Therefore, the sensitivity of the metal sheets 51 and 52 is high.

2) The follower bar 30 is molded from elastic material, therefore it can be easily deformed to force the longitudinal ribs 34 against the metal sheets 51 and 52, causing the metal sheets 51 and 52 to contact each other and to further cut off power supply from the electric rolling door 70.

3) The through holes 41 of the sheet insulator 40 are arranged corresponding to longitudinal ribs 34, therefore the metal sheets 51 and 52 are positively forced into contact with each other to cut off power supply from the electric rolling door 70 when the follower bar 30 is compressed.

4) Because the two opposite sides of the electric rolling door 70 are moved in the vertical sliding grooves 71 and 72, objects may enter the vertical sliding grooves 71 and 72 to hinder the down stroke of the electric rolling door 70. Therefore, the actuators 80 are fastened to the two opposite ends of the bottom rail 74 of the electric rolling door 70 to detect objects in the vertical sliding grooves 71 and 72, and to cut off power supply from the electric rolling door 70 when they are stopped by an object during the down stroke of the electric rolling door.

I claim:

1. A safety switch for a door comprising:

a follower bar molded from elastic material and fastened to the bottom rail of an electric rolling door, said follower bar comprising a casing having a longitudinal top open chamber, two parallel top flaps bilaterally and partially covered over said longitudinal top open chamber, an longitudinal inside chamber, and two longitudinal ribs inside said longitudinal inside chamber;

a sheet insulator longitudinally mounted inside the longitudinal top open chamber of said follower bar and having two longitudinal rows of through holes corresponding to the longitudinal ribs of said follower bar;

a first metal sheet and a second metal sheet longitudinally mounted inside the longitudinal top open chamber of said follower bar and separated by said sheet insulator and covered by said top flaps; and two actuators respectively fastened to two opposite ends of the bottom rail of the electric rolling door, each actuator comprising a top plate fastened to one end of the bottom rail of the electric rolling door and having a first pair of downward lugs and a second pair of downward lugs, a first pressure plate pivoted to said first pair of downward lugs, said first pressure plate having a through hole near one end, a second pressure plate having one end inserted through the through hole of said first pressure plate and pivoted to said second pair of downward lugs and an opposite end attached to the casing of said follower bar at a bottom side;

wherein when the casing of said follower bar or one actuator is stopped by an object during the down stroke of the electric rolling door, the casing of said follower bar is deformed to force said longitudinal ribs upwards against said metal sheets, causing said metal sheets to contact each other at the through holes of said sheet insulator and to further cut off power supply from the electric rolling door.

2. The safety switch of claim 1 further comprising a rubber packing sheet sealed to the top flaps of said casing of said follower bar and adhered to the bottom rail of the electric rolling door.

3. The safety switch of claim 1 wherein each actuator is fastened to the bottom rail of the electric rolling door by a respective locating plate, said locating plate having a horizontal coupling hole at one end, which receives the bottom rail of the electric rolling door and the top plate of the respectively actuator, and a locating hole at a top side for mounting a tightening up screw to hold down the bottom rail of the electric rolling door and the top plate of the respective actuator in said horizontal coupling hole.

* * * * *